US007003886B2

(12) United States Patent
Okabe

(10) Patent No.: US 7,003,886 B2
(45) Date of Patent: Feb. 28, 2006

(54) INNER CUTTER UNIT AND OUTER CUTTER UNIT FOR AN ELECTRIC SHAVER

(75) Inventor: Masaki Okabe, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 10/418,641

(22) Filed: Apr. 18, 2003

(65) Prior Publication Data

US 2003/0196335 A1 Oct. 23, 2003

(30) Foreign Application Priority Data

Apr. 18, 2002 (JP) ..... 2002-116524
Apr. 10, 2003 (JP) ..... 2003-106937

(51) Int. Cl.
*B26B 19/04* (2006.01)

(52) U.S. Cl. ..... 30/346.51; 30/222; 30/346.54; 30/350

(58) Field of Classification Search ..... 30/346.51, 30/346.54, 350, 222, 113.6, 43.8–43.92; 384/103, 105, 106, 279, 283–285
See application file for complete search history.

(56) References Cited

U.S. PATENT DOCUMENTS 2,431,430 A * 11/1947 Shaw ..... 384/285
3,611,572 A 10/1971 Futterer
4,459,047 A * 7/1984 Silver ..... 384/105

FOREIGN PATENT DOCUMENTS

EP 0 566 234 10/1993

* cited by examiner

*Primary Examiner*—Allan N. Shoap
*Assistant Examiner*—Carolyn Blake
(74) *Attorney, Agent, or Firm*—Koda & Androlia

(57) ABSTRACT

An electric rotary or reciprocating shaver including an inner cutter unit, with which inner cutter blades that make a sliding contact with the blade surface of an outer cutter, being provided with recesses that is filled with a synthetic resin. The outer cutter of an outer cutter unit that is used in combination with such an inner cutter unit can be formed also with a recess in the outside surface of the outer cutter with such an outside recess filled with a synthetic resin.

4 Claims, 1 Drawing Sheet

INNER CUTTER UNIT AND OUTER CUTTER UNIT FOR AN ELECTRIC SHAVER

BACKGROUND OF THE INVENTION

1. Field of the Invention

The present invention relates to an electric shaver and more particularly to an inner cutter unit and an outer cutter unit provided in an upper portion of a rotary type or reciprocating type electric shaver.

2. Prior Art

In rotary type or reciprocating type electric shavers, a shaver head frame is disposed on the upper portion of a main body case of a shaver. In the shaver head frame, inner and outer cutter units are detachably installed; and the main body case includes, in addition to other components, a driving source (motor), a driving mechanism, a power supply section and an operating switch.

The inner cutter unit generally comprises a plurality of inner cutter blades formed in an upright posture in the circumferential direction on an inner cutter base that is made of a synthetic resin. The inner cutter unit is installed in the shaver head frame with its inner cutter base engaged with a driving shaft of a driving mechanism, the driving shaft extending from the main body case of the shaver.

On the other hand, the outer cutter of the outer cutter unit is integrally supported in an outer cutter frame, and the outer cutter unit is installed in the shaver head frame so as to cover the inner cutter unit.

Some shavers have only one set of inner and outer cuter cutter units, and other shavers include a plurality of (three, for instance) sets of inner and outer cutter units.

The outer cutter is formed in a mesh configuration in which hair entry openings through which hair is introduced are formed by partition ribs that form outer cutter blades. The inner cutter blades have blade surfaces and the outer cutter blades have blade surfaces, and these blade surfaces face each other.

The inner cutter blades are rotationally driven (in a rotary shaver) or caused to make a reciprocating motion (in a reciprocating shaver) together with the inner cutter base. Hair that is introduced into the hair entry openings is cut when the blade surfaces of the inner cutter blades rotate (in a rotary shaver) or make a reciprocating motion (in a reciprocating shaver) while sliding (in the direction of arrow in FIG. 3) against the blade surfaces of the outer cutter.

Some shavers include only one set of inner cutter unit and outer cutter, and other shavers involve a plurality of (three, for instance) sets of inner and outer cutter units.

FIG. 3 shows a relationship between an outer cutter 51 and one of the inner cutter blades 52 of an electric rotary shaver of prior art.

In this shaver, the outside surface portions 53 of the ribs 58 (two ribs 58 are shown in FIG. 3) that define the hair entry openings 57 in the outer cutter 51 are coated with a synthetic resin 54 such as Teflon, etc. This coating is made in order to provide a smooth contact of the shaver with the skin and in order to provide a particular design effect. In some shavers, each of the ribs 58 (see the right side rib 58) is formed with an inside surface recess 55, and this recess 55 is filled with a synthetic resin 54 in order to provide smooth sliding contact between the outer cutter 51 and the inner cutter blade 52.

However, the prior art outer cutter 51 shown in FIG. 3 has several problems.

Firstly, if the adhesive force of the synthetic resin 54 that covers the outside surface portions 53 or is filled in the inside surface recess 55 is not securely maintained, the resin 54 is peeled off during the use of the shaver. If, for instance, the resin 54 on the outside surface portions 53 is peeled off, the contact of the shaver with the skin becomes poor, and the design characteristics are also deteriorated. If the resin 54 in the inside surface recess 55 is detached, the friction with the blade surface 56 of the inner cutter blade 52 increases, and the rotational efficiency (oscillation efficiency in the case of a reciprocating shaver) can easily decrease.

Secondly, for the resin 54 that is applied as a coating on the outside surface portions 53 of the outer cutter 51, there is nothing to serve as a reference for the thickness of such a resin 54. As a result, even thickness of the resin 54 is not obtainable for all the outside surface portions 53 of the outer cutter 51.

SUMMARY OF THE INVENTION

Accordingly, the present invention is to solve the above-described problems in the prior art shavers.

It is a primary object of the present invention to provide an inner cutter unit and an outer cutter unit for an electric shaver that retains an increased adhesion force of the resin which is applied as a coating to the outer cutters and inner cutters (or inner cutter blades).

It is a further object of the present invention to provide an inner cutter unit and an outer cutter unit for an electric shaver in which resin thickness is adjustable to a uniform value, and the driving efficiency of the inner cutter blades is improved.

The above objects are accomplished by a unique structure of the present invention for an inner cutter unit used in an electric shaver in which the inner cutter unit having inner cutter blades that make a sliding contact with an outer cutter is disposed in an upper portion of the main body case of the electric shaver; and in the present invention, each of the inner cutter blades is provided, in its blade surface that makes a sliding contact with the blade surface of the outer cutter, with a recess; and the recess is filled with a synthetic resin.

The above object is further accomplished by another unique structure of the present invention for an outer cutter unit for an electric shaver in which the outer cutter unit is disposed in an upper portion of the main body case of the electric shaver with an outer cutter of the outer cutter unit being held in an outer cutter frame; and in the present invention, the outer cutter is provided, in an outside surface thereof, with a recess; and the recess is filled with a synthetic resin.

In this structure, the outer cutter can be further provided, in an inside surface (blade surface) thereof which is opposite from the outside surface, with a recess, so that such a recess is also filled with a synthetic resin.

Furthermore, the recess formed in the outside surface and the recess formed in the inside surface of the outer cutter can be formed so as to communicate with each other so that the synthetic resin are filled in both recesses in a continuous fashion in the communicated recesses.

DETAILED DESCRIPTION OF THE INVENTION

Preferred embodiments of the present invention will be described in detail below with reference to the accompanying drawings.

The term "electric shaver" refers to both rotary type shavers and reciprocating type shavers; and in the embodiments below, the present invention will be described on an electric rotary shaver.

An electric rotary shaver to which the present invention is applied is generally comprised of a main body case and a shaver head frame that is disposed on the upper portion of the main body case. The main body case of the shaver includes, in addition to other components, a driving source and a driving mechanism; and the shaver head frame is equipped with an inner cutter unit and an outer cutter unit.

The inner cutter unit is comprised of an inner cutter base made of a synthetic resin and a plurality of inner cutter blades provided on the inner cutter base in an upright posture and in the circumferential direction. The inner cutter unit is mounted in the shaver head frame with its inner cutter base being engaged with a driving shaft of the driving mechanism, the driving shaft extending from the main body case. The outer cutter unit includes an outer cutter supported in an outer cutter frame in an integral fashion. The outer cutter unit is mounted on the shaver head frame in a manner that the outer cutter unit covers the inner cutter unit.

Figure 1:
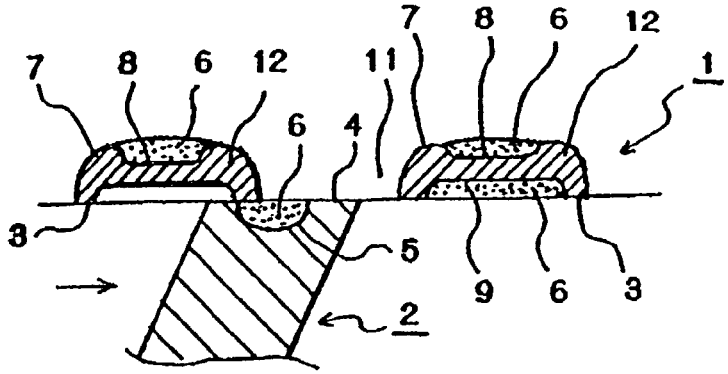
FIG. 1 illustrates in cross-section one of the inner cutter blades and a part of the outer cutter according to one embodiment of the inner and outer cutter units for an electric shaver of the present invention.

As seen from FIG. 1, the outer cutter 1 and the inner cutter blade 2 are disposed so as to face each other. Metal cutters made of stainless steel, etc. are used for the outer cutter 1 and the inner cutter blade 2.

The outer cutter is formed, for instance, in a mesh-like configuration, so that a plurality of ribs 12, which are formed so as to bulge outward in the form of a dome, extends radially, thus forming hair entry openings 11. An outer cutter blade surface 3 is formed on the bottom surface of the outer cutter 1 or of each one of the ribs 12 that faces the inner cutter blade 2. In other words, the end surface (bottom surface) of each one of the ribs 12, that form outer cutter blades, has the outer cutter blade surface 3. On the other hand, an inner cutter blade surface 4 is formed on the tip end of the inner cutter blade 2 that is rotationally driven in the direction of arrow when the inner cutter base (not shown) is rotated. When the blade surface 4 of the inner cutter blade 2 rotates while making sliding contact with the blade surface 3 of the outer cutter 1, hair (whiskers) that has entered into the shaver head frame through the hair entry openings 11 is cut (or shaved).

In the blade surface 4 of the inner cutter blade 2, a recess 5 is formed. The recess 5 is filled with a synthetic resin 6 such as Teflon resin, fluororesin, etc. The recess 5 is filled with the synthetic resin 6 by, for instance, blowing the resin into the recess 5, so that the resin 6 is not easily detached from the recess 5. The upper edge portion of the recess 5 can act as a reference surface during the process of filling the resin 6 in the recess 5, thus the resin 6 is not applied to a thickness that protrudes over the blade surface 4. Accordingly, the adjustment of the resin thickness can be easily accomplished. With the resin 6 filled in the recess 5 of the inner cutter blade 2, the sliding motion of the blade surface 4 of the inner cutter blade 2 is smooth, providing an improved rotational efficiency.

On the other hand, each of the ribs 12 of the outer cutter 1 is formed, in its outside surface portions 7, with a recess 8. The recess 8 (or the outside surface recess 8) is filled with a synthetic resin 6 such as a Teflon resin, fluororesin, etc. The outside surface recess 8 is filled with the resin 6 by, for instance, blowing the resin 6 into the recess 8, so that the resin 6 is not easily detached from the recess 8. The upper edge portion of the outside surface recess 8 can act as a reference surface during the process of filling recess 8, thus the resin 6 is not applied to a thickness that protrudes over the outside surface portion 7. Accordingly, the adjustment of the resin thickness can be easily accomplished. With the resin 6 evenly filled in the outside surface recess 8, the contact of the outer cutter 1 with the skin is improved. Since the resin 6 is not easily detached from the recess 8, the design characteristics of the outer cutter 1 can be maintained without any loss of particular designs executed in the outside surface portions 7.

It is desirable that the outside surface recess 8 formed in the rib 12 and filled with the resin 6 be formed in some or all the areas of the rib 12 that correspond to the shaving area which comes into contact with the skin. However, such a recess can be formed in some or all the areas outside the shaving area (for example, in ribs that partition ornamental openings formed in the outer cutter 1 from each other, etc.). The outside surface recess 8 filled with the resin 6 can be formed for the entire region of the outer cutter 1.

Furthermore, as seen from FIG. 1, an inside surface recess 9 can be formed on the opposite sides of the outer cutter 1. More specifically, each of the ribs 12 of the outer cutter 1 can be formed with a recess 9 in its inside surface portion (or in the outer cutter blade surface 3) that is opposite from the outside surface portion 7, so that the recess 9 (or the inside surface recess 9) is also filled with resin 6. With the resin 6 filled in the inside surface recess 9 of the outer cuter 1, the sliding motion of the inner cutter blade 2 can be made further smoothly by a combined effect with the resin 6 embedded in the blade surface 4 of the inner cutter blade 2, and the rotational efficiency is further improved.

Figure 2:
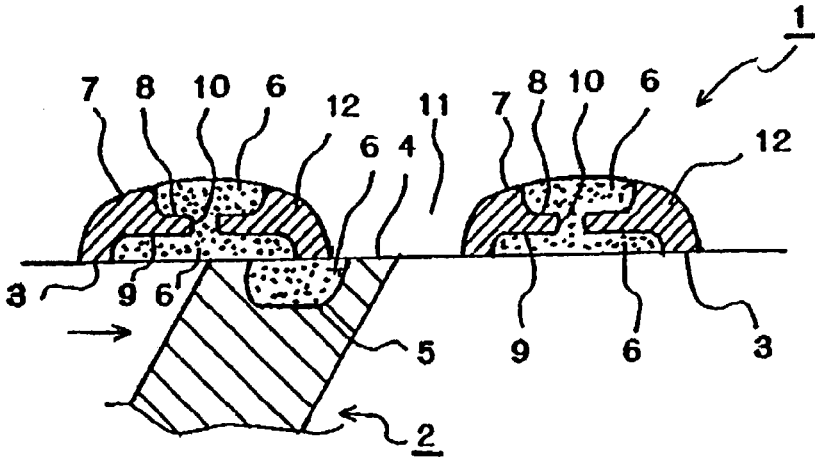
FIG. 2 illustrates in cross-section one of the inner cutter blades and a part of the outer cutter according to another embodiment of the inner and outer cutter units for an electric shaver of the present invention.
Figure 3:
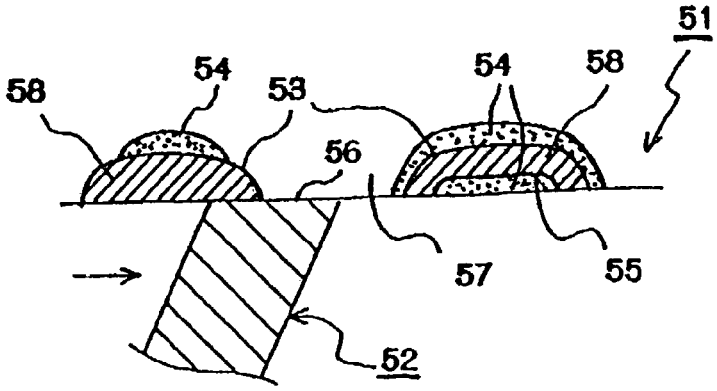
FIG. 3 PRIOR ART
FIG. 3 illustrates in cross-section an inner cutter blade and a part of the outer cutter of a prior art inner and outer cutter units for an electric shaver.

In the structure shown in FIG. 2, through the structure of the inner cutter blade 2 is the same as that described above, the outside surface recess 8 and the inside surface recess 9 of the outer cutter 1 are formed so as to communicate with each other via a communicating opening 10 formed in between; and the outside surface recess 8 and the inside surface recess 9 are both filled with the resin 6 via the communicating opening 10 in a manner that the resin 6 of and the outside surface recess 8 and the resin 6 of the inside surface recess 9 are continuous.

Since the resin 6 can be applied as a filling so that the resin 6 does not protrude over the outside surface recess 8 and the inside surface recess 9 of the outer cutter 1 as described above, the adjustment of the resin thickness can be done easily. Furthermore, since the resin 6 can bite into the recesses 8 and 9 of the outer cutter 1 more securely, the contact of the outer cutter 1 with the skin and the design characteristics can be favorably maintained at an improved level. Also, a smooth sliding motion of the blade surface 4 of the inner cutter blade 2 in the direction of arrow in FIG. 2 is assured, and the rotational efficiency is improved.

Preferred embodiments of the present invention are described above; however, the present invention is not limited to the above-described electric rotary shaver, and it is applicable to inner cutter units and outer cutter units used in reciprocating type electric shavers. Furthermore, the shape and design of the outside surface recesses 8 of the outer cutter 1 and the recesses 4 of the inner cutter blades 2 are arbitrary, and the material of the resin 6 that is used as a filling is also arbitrary. In addition, it goes without saying that numerous modifications can be made without departing from the spirit of the invention; and the present invention is applicable to shavers in which a single set of inner and outer cutter units are installed or to shavers in which a plurality of such sets are installed.

As seen from the above, according to the present invention, the inner cutter blades are formed, in the blade surfaces thereof that make sliding contact with the blade surfaces of the outer cutters, with recesses, and these recesses are filled with a synthetic resin. Accordingly, the sliding motion of the blade surfaces of the inner cutter blades with the outer cutters is smooth, and an improved rotational efficiency is obtained. Furthermore, the resin filled in the recesses is not easily detached from the recesses, and the thickness of the resin is easily adjusted.

Furthermore, according to the present invention, recesses are formed in the outside surface of the ribs of the outer cutter, and such recesses are filled with a synthetic resin. Accordingly, the contact of the outer cutter with the skin and the design characteristics are favorably maintained. The resin filled in the recesses is not easily detached from the recesses, and the adjustment of the resin thickness can be easily performed. Accordingly, the thickness of the outer cutter can be adjusted to any desired value.

Furthermore, the outer cutter can be further formed with recesses in the inside surfaces of the ribs that are on the opposite side from outside surfaces, and these inside surface recesses can be filled with a resin as well. In this structure, the friction between the blade surface of the outer cutter and the inner cutter blades is even further reduced, and the driving efficiency is further improved.

In addition, by way of forming the outside surface recesses and the inside surface recesses of the outer cutter to communicate with each other via communicating openings and filling these outside and inside surface recesses with a resin, the degree to which the resin bites into (the recesses of) the outer cutter is increased, and the contact of the outer cutters with the skin and the design characteristics are favorably maintained. Moreover, the sliding contact with the blade surfaces of the inner cutter blades become smoother, and the rotational efficiency is improved.

What is claimed is:

1. A cutter unit for an electric shaver for shaving human facial hair comprising an inner cutter unit and an outer cutter unit wherein said outer cutter unit is disposed in an upper portion of a main body case of said electric shaver with an outer cutter of said outer cutter unit being held in an outer cutter frame, wherein said outer cutter is provided, in an outside surface thereof which contacts facial skin of a user, with a plurality of recesses and only said plurality of recesses are filled with a synthetic resin and said inner cutter unit having an inner cutter blade that makes sliding contact with an inside surface of said outer cutter is disposed in a upper portion of said main body case of said electric shaver, wherein said inner cutter blade is provided, in a blade surface thereof that makes a sliding contact with said inner surface of said outer cutter unit, with a plurality of recesses, and only said plurality of recesses are filled with a synthetic resin whereby not only is contact of said outside of said outer cutter unit and facial skin of a user improved but also a sliding contact between a blade surface of said inner cutter and an inner surface of said outer cutter is improved.

2. The cutter unit of claim 1, wherein said outer cutter unit is further provided, in an inside surface thereof which is opposite from said outside surface, with a plurality of recesses, and only said plurality of recesses are filled with a synthetic resin.

3. The cutter unit according to claim 2, wherein said plurality of recesses formed in said outside surface of said outer cutter unit and said plurality of recesses formed in said inside surface of said outer cutter unit are communicated with each other and are both fined with said synthetic resin.

4. The outer cutter unit according to claim 1, wherein said synthetic resin is selected from a group consisting of Teflon resin and fluororesin.

* * * * *